US007152518B2

(12) United States Patent
Kondo

(10) Patent No.: US 7,152,518 B2
(45) Date of Patent: Dec. 26, 2006

(54) STRUCTURE OF FUEL INJECTION PUMP FOR EXTENDING SERVICE LIFE

(75) Inventor: Jun Kondo, Oobu (JP)

(73) Assignee: Denso Corporation (JP)

( * ) Notice: Subject to any disclaimer, the term of this patent is extended or adjusted under 35 U.S.C. 154(b) by 647 days.

(21) Appl. No.: 10/178,767

(22) Filed: Jun. 25, 2002

(65) Prior Publication Data

US 2002/0197176 A1 Dec. 26, 2002

(30) Foreign Application Priority Data

Jun. 26, 2001 (JP) ..... 2001-192783

(51) Int. Cl.
*F01B 1/00* (2006.01)

(52) U.S. Cl. ..... 92/72

(58) Field of Classification Search ..... 92/72, 92/129; 384/424, 439
See application file for complete search history.

(56) References Cited

U.S. PATENT DOCUMENTS 5,183,340 A * 2/1993 Higginbotham et al. .... 384/420
6,289,875 B1 * 9/2001 Shinohara et al. ..... 123/450
2001/0015200 A1 8/2001 Mori

FOREIGN PATENT DOCUMENTS

JP 2001-227426 8/2001

* cited by examiner

*Primary Examiner*—F. Daniel Lopez
(74) *Attorney, Agent, or Firm*—Nixon & Vanderhye PC

(57) ABSTRACT

An improved wear resisting structure of a fuel injection pump is provided. The fuel injection pump has a plunger reciprocating to pressurize fuel within a compression chamber and a cam mechanism installed on a torque input shaft. The cam mechanism revolves following rotation of a torque input shaft to move the plunger. Washers are installed fixedly within washer chambers formed in an inner wall of the housing. The washers work as bearing surfaces which are in contact with and holds the cam mechanism from moving in an axial direction thereof, thereby avoiding excessive wear of portions of the housing.

11 Claims, 7 Drawing Sheets

STRUCTURE OF FUEL INJECTION PUMP FOR EXTENDING SERVICE LIFE

BACKGROUND OF THE INVENTION

1. Technical Field of the Invention

The present invention relates generally to an improved structure of a fuel injection pump for use in internal combustion engines which results in an increase in service life of the fuel injection pump.

2. Background Art

Fuel injection pumps are known in the art which are of the type wherein a rotary mechanism such as a cam is installed eccentrically on a torque input shaft to reciprocate a plunger to pressurize fuel sucked into a compression chamber.

The torque input shaft is supported by a bearing and connected to a drive shaft of the engine through, for example, a helical gear. The use of the helical gear will cause a thrust or axial load to be produced which acts on the torque input shaft when the torque input shaft is rotated by the output of the engine, so that the rotary mechanism installed on the torque input shaft is urged in an axial direction of the torque input shaft and collides with a wall of a pump housing working as a bearing surface. The rotary mechanism, therefore, revolves in contact with the wall of the pump housing. Usually, the pump housing is made of aluminum for lightening and ease of machining. The aluminum is a relatively soft material. The revolution of the rotary mechanism in contact with the wall of the pump housing results in premature wear of the wall. This will result in an increase in undesirable oscillation of the torque input shaft and the rotary mechanism in the axial direction thereof, thus resulting in an excessive increase in wear of the pump housing, which leads to a decrease in service life of the fuel injection pump.

SUMMARY OF THE INVENTION

It is therefore a principal object of the invention to avoid the disadvantages of the prior art.

It is another object of the invention to provide an improved structure of a fuel injection pump which is designed to minimize undesirable wear of bearing surfaces of the fuel injection pump.

According to one aspect of the invention, there is provided a fuel injection pump which may be used in automotive diesel engines. The fuel injection pump comprises: (a) a housing having a first and a second chamber formed therein; (b) a plunger disposed within the first chamber of the housing so as to reciprocate along a given path of travel; (c) a cam mechanism installed on a torque input shaft, the cam mechanism revolving within the second chamber following rotation of the torque input shaft to move the plunger within the first chamber for compressing fuel sucked into a fuel compression chamber; and (d) a washer installed fixedly within a washer chamber formed in an inner wall of the second chamber of the housing. The washer works as a bearing surface which is in contact with and holds the cam mechanism from moving in an axial direction thereof, thereby avoiding excessive wear of a portion of the housing opposed to the cam mechanism. The washer may be implemented by a typical one.

In the preferred mode of the invention, washer is made of an annular disc through which the torque input shaft extends.

The washer may be secured within the washer chamber at at least two peripheral portions of the washer using fastening members.

The fastening members may be formed integrally with the washer.

The washer may have a protrusion formed on a periphery thereof which engages a mating part provided on a periphery of the washer chamber.

The washer and the washer chamber may alternatively be so shaped geometrically as to hold relative motion thereof.

The washer and the washer chamber may alternatively be located eccentrically to the torque input shaft for establishing a firm joint therebetween.

The washer and the washer chamber may be of polygonal shape.

The washer may be fitted within the washer chamber.

The washer may alternatively be held within the washer chamber through holding members provided around a periphery of the washer chamber.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a partially sectional view taken along the line B—B in FIG. 2(*a*);

FIG. 3(*b*) is a partially sectional view taken along the line B—B in FIG. 3(*a*);

FIG. 4(*b*) is a partially sectional view taken along the line B—B in FIG. 4(*a*);

FIG. 5(*b*) is a partially sectional view taken along the line B—B in FIG. 5(*a*);

FIG. 6(*b*) is a partially sectional view taken along the line B—B in FIG. 6(*a*);

FIG. 7(*b*) is a partially sectional view taken along the line B—B in FIG. 7(*a*).

DESCRIPTION OF THE PREFERRED EMBODIMENTS

Figure 1:
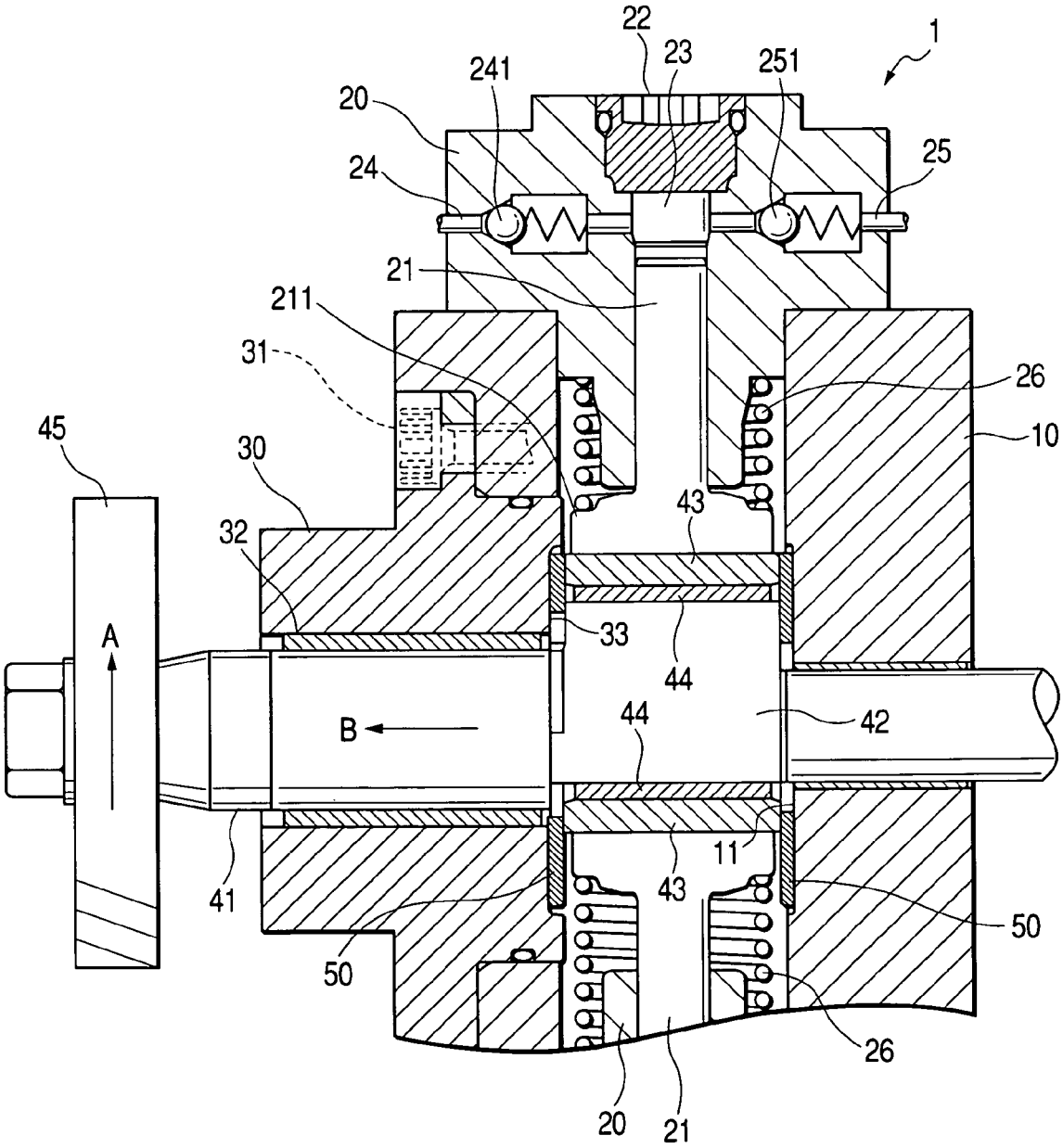
FIG. 1 is a partially sectional view which shows an internal structure of a fuel injection pump according to the first embodiment of the invention.

Referring to the drawings, wherein like reference numbers refer to like parts in several views, particularly to FIG.

1, there is shown a fuel injection pump 1 for diesel engines according to the first embodiment of the invention.

The fuel injection pump 1 has a pump housing made up of a housing body 10, a hollow cylinder head 20, and a cam cover 30. The housing body 10 and the cam cover 30 are made of aluminum. The cylinder head 20 is made of metal and has formed therein cylindrical chambers within which two plungers 21 are supported so as to reciprocate vertically, as viewed in the drawing, to compress fuel sucked into fuel compression chambers 23. The fuel compression chambers 23 are each defined by an inner wall of the cylinder head 20, an end of a sealing plug 22, and an end of the plunger 21.

The cam cover 30 is joined to the housing body 10 through bolts 31 and has disposed therein a journal bearing 32 which supports a cam shaft 41. The cam shaft 41 is retained rotatably in the housing body 10 and the cam cover 30. A cam 42 having a circular cross section is joined to the cam shaft 41 eccentrically. The cam 42 may be formed integrally with the cam shaft 41. The plungers 21 are opposed to each other diametrically across the cam shaft 41. In other words, the two plungers 21 are arranged in alignment with each other across the cam shaft 41. More than two plungers may alternatively be installed around the cam shaft 41 at regular intervals. A bush 44 is fitted slidably on the cam 41. A shoe 43 which is square in external form is fitted slidably on the bush 44. Plunger heads 211 of the plunger 21 and portions of an outer peripheral surface of the shoe 43 in contact with the plunger heads 211 are formed to be flat and in direct contact with each other. The cam 42 and the shoe 43 forms a cam mechanism.

A helical gear 45 is installed on an end of the cam shaft 41 to be rotatable together with the cam shaft 41. The helical gear 45 is joined mechanically to a crank shaft (not shown) of the diesel engine through a gear train (not shown) so that it may turn in a direction, as indicated by an arrow A, following rotation of the crank shaft. The rotation of the helical gear 45 in the direction A causes a thrust to be produced which urges the cam shaft 41 in a direction, as indicated by an arrow B.

The rotation of the cam shaft 41 causes the plungers 21 to reciprocate following movement of the cam 42 through the shoe 43. The reciprocating of the plungers 21 will cause the fuel sucked into each of the fuel compression chambers 23 through a check valve 241 installed in a fuel inlet path 24 to be compressed. The check valve 241 permits the fuel to flow only into the fuel compression chamber 23.

The fuel compression chamber 23 also leads to a fuel outlet path 25. A check valve 25 is installed in the fuel outlet path 25 to avoid a back flow of the fuel into the fuel compression chamber 23. The fuel pressurized within the fuel compression chamber 23 is discharged from the fuel outlet path 25 and fed to a common rail (not shown) of a fuel supply system of the diesel engine.

Springs 26 are installed in the cylinder head 20 to urge the plungers 21 (i.e., the plunger heads 211) into constant engagement with the shoe 43 elastically. The mechanical pressure produced by each of the springs 26 acts on a wider contact area between the flat surface of the shoe 43 and the flat surface of the plunger head 211. The shoe 32 revolves about the cam shaft 41 following rotation of the cam 42 without rotating in itself.

The housing body 10 and the cam cover 30 have defined by inner walls thereof adjacent the cam 42 washer chambers 11 and 33 within which washers 50 are disposed. Each of the washers 50 has an outer wall abutting a corresponding one of the housing body 10 and the cam cover 30 and an inner wall working as a bearing surface on which the cam 42 slides and revolves and which holds the cam 42 from moving in an axial direction thereof.

Figure 2A:
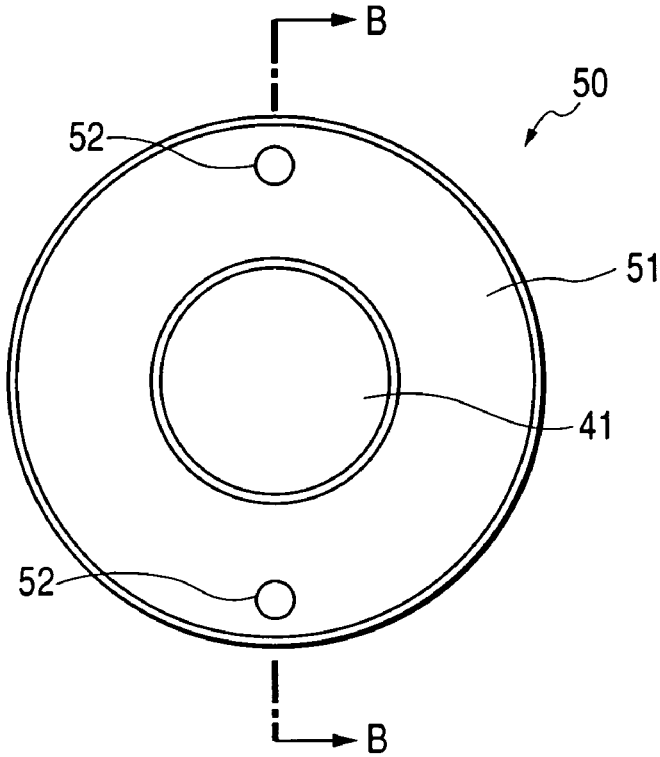
FIG. 2(*a*) is a front view which shows a washer installed between a cam and each of a cam cover and a housing to minimize wear of the cam cover and the housing due to a thrust acting on a cam shaft.
Figure 2B:
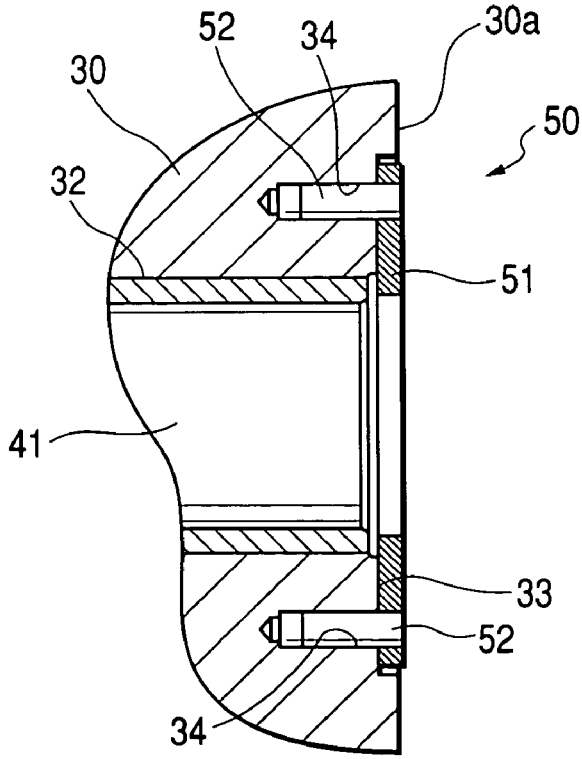

FIGS. 2(*a*) and 2(*b*) illustrate structures of the washer chamber 33 formed in the cam cover 30 and the washer 50 disposed therein in detail. Note that the washer chamber 11 formed in the housing 10 and the washer 50 disposed therein are identical in structure with the washer chamber 33 and the washer 50 disposed within the washer chamber 33, respectively, and explanation thereof in detail will be omitted in the following discussion.

The washer 50 is made up of an annular body 51 and pins 52 used to mount the washer 50 on the cam cover 30. The pins 51 are fitted in peripheral portions of the annular body 51 diametrically opposed to each other. The pins 51 extend perpendicular to a plane of the annular body 51.

The washer chamber 33 is defined by an annular recess formed in the end 30*a* of the cam cover 30 facing the cam 42. The depth of the washer chamber 33 is substantially identical with or smaller than the thickness of the annular body 51. The diameter of the washer chamber 33 is slightly greater than that of the annular body 51.

The cam cover 30 has formed therein holes 34 into which the pins 52 are driven in a press fit to secure the washer 50 within the washer chamber 33.

The operation of the fuel injection pump 1 will be described below.

The engine torque is transmitted to the cam shaft 41 through the helical gear 45, so that the cam shaft 41 rotates. The rotation of the cam shaft 41 causes the cam 42 to revolve, so that the shoe 43 revolves around the cam shaft 41 without rotating in itself. The revolution of the shoe 43 causes each of the plungers 21 to slide on the shoe 43 and move up and down.

When the plunger 21 moves downward from the top dead center, it will cause the fuel which is discharged from a feed pump (not shown) and regulated in flow rate by a regulator (not shown) to be sucked into the fuel compression chamber 23 through the check valve 241 from the fuel inlet path 24. When the plunger 21 reaches the bottom dead center and moves upward again, it will cause the check valve 241 to be closed, so that the pressure of the fuel within the fuel compression chamber 23 to rise. When the fuel pressure within the fuel compression chamber 23 exceeds the pressure developed downstream of the check valve 251, it will cause the check valve 251 to be opened, so that the fuel in the fuel compression chamber 23 flows out of the fuel outlet path 25 and enters the common rail (not shown). The fuel stored in the common rail is supplied to fuel injectors (not shown) in a known manner.

When the helical gear 45 is rotated in the direction A, as shown in FIG. 1, by the torque transmitted from the crank shaft of the engine, it will cause the cam shaft 41 to be thrust in the direction B (i.e., the axial direction of the cam shaft 41). A change in speed of the crank shaft of the engine will result in a change in pressure urging the cam shaft 41 in the direction B. The washers 50 disposed outside the cam 42 and the shoe 43 serve as bearing surfaces which avoid a physical collision of the cam 42 and the shoe 43 with the housing 10 and the cam cover 30 when the cam shaft 41 is thrust in the direction B. This avoids excessive wear of the housing 10 and the cam cover 30 The washers 50 are, as described above, fixed on the housing 10 and the cam cover 30, thus holding each of the washers 50 from moving relative to a corresponding one of the housing 10 and the cam cover 30 following the rotation of the cam 42. This avoids relative motion of the washers 50 and the housing 10 and the cam cover 30, which also results in a further decrease in wear of the housing 10 and the cam cover 30, especially due to the thrust acting on the cam shaft 41, which prolongs a service life of the fuel injection pump 1.

The washers 50 are, as described above, installed fixedly on 15 the housing and the cam cover 30 through the pins 52, thus avoiding undesirable rotation and play of the washers 50 when the cam 42 rotates, and the shoe 43 moves.

Figure 3A:
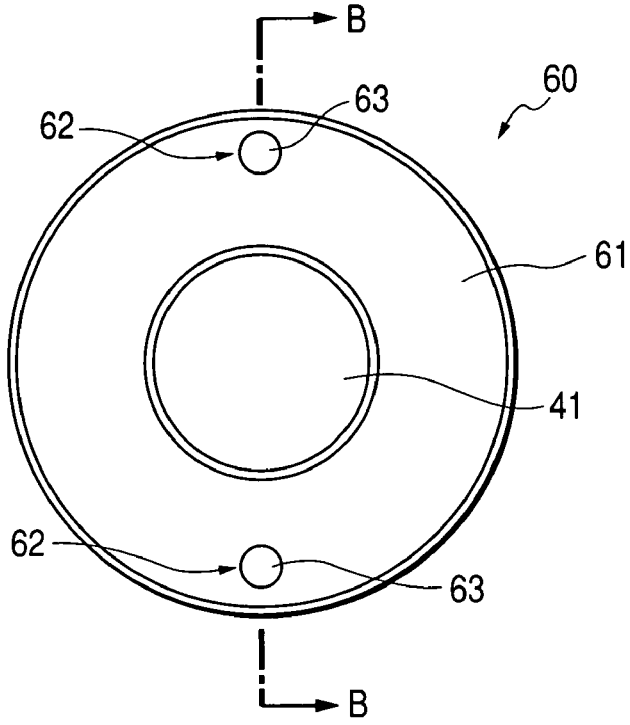
FIG. 3(*a*) is a front view which shows a washer installed between a cam and each of a cam cover and a housing according to the second embodiment of the invention.
Figure 3B:
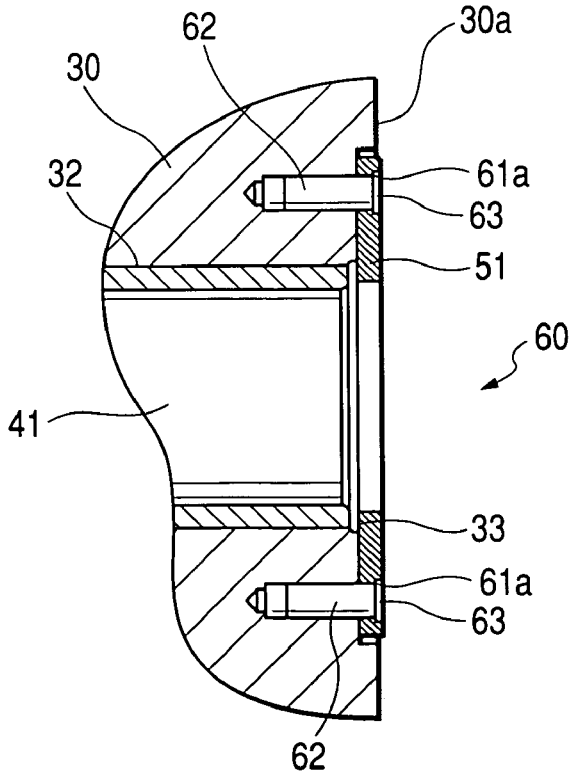

FIGS. 3(*a*) and 3(*b*) show the second embodiment of the invention which is different from the first embodiment only in that washers 60 (only one is shown for the brevity of illustration) consist of an annular body 61 and pins 62 which are not press fit in the annular body 61. Other arrangements are identical, and explanation thereof in detail will be omitted here.

Each of the pins 62 has a head 63 formed on an end thereof. The annular body 61 has formed therein a recess 61*a* within which the head of the pin 62 is placed without projecting from the plane of the annular body 61. The pins 62 are driven into each of the housing 10 and the cam cover 30 to secure the annular body 61 thereon.

The washers 50 and 60 in the first and second embodiments may be installed on the housing 10 and the cam cover 30 using three or more fastening members such as pins or screws.

Figure 4A:
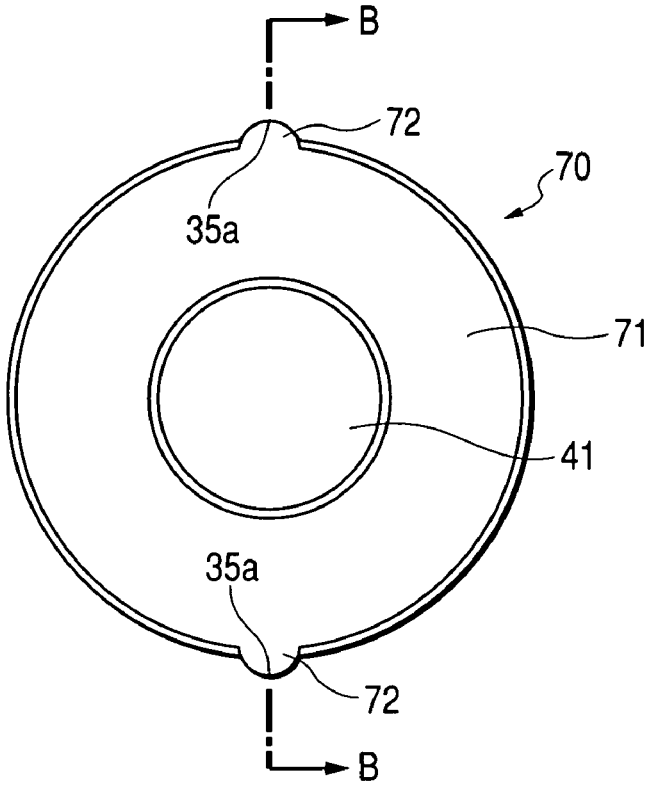
FIG. 4(*a*) is a front view which shows a washer installed between a cam and each of a cam cover and a housing according to the third embodiment of the invention.
Figure 4B:
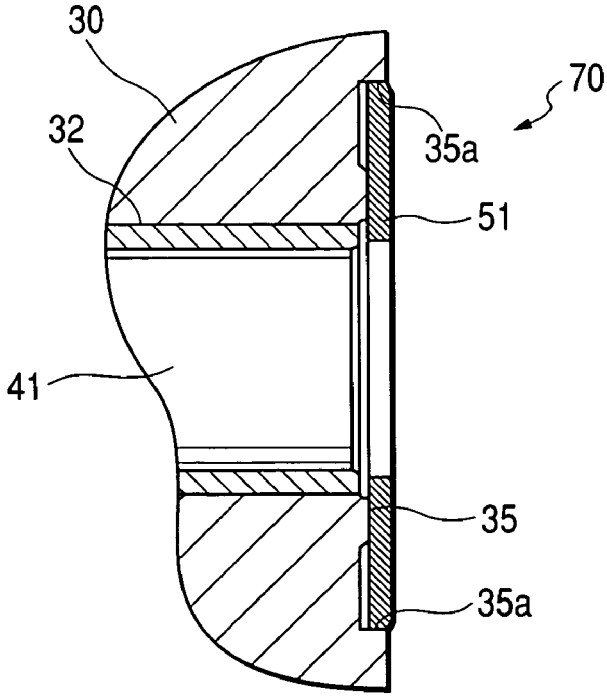

FIGS. 4(*a*) and 4(*b*) show the third embodiment of the invention which is different from the first embodiment in the geometrical shape of washers 70 and washer chambers 35 formed in the cam cover 30 and the housing 10. Other arrangements are identical, and explanation thereof in detail will be omitted here.

The washer 70 has tabs 72 projecting from the periphery of an annular body 71 in a radial direction of the annular body 71. The tabs 72 are diametrically opposed to each other with respect to the cam shaft 41. The cam cover 30 has formed therein a washer chamber 35 which has mating recesses 35*a* formed in a peripheral wall thereof. The tabs 72 of the washer 70 are fitted within the mating recesses 35*a*, thereby establishing a firm join of the washer 70 to the washer chamber 35.

The washer 70 may alternatively be secured fixedly within the washer chamber 35 using one pair of mating parts.

Figure 5A:
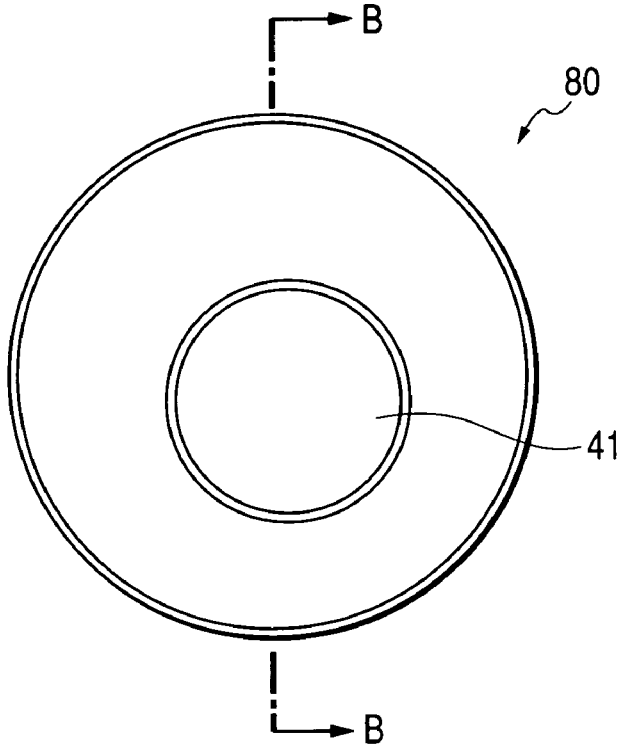
FIG. 5(*a*) is a front view which shows a washer installed between a cam and each of a cam cover and a housing according to the fourth embodiment of the invention.
Figure 5B:
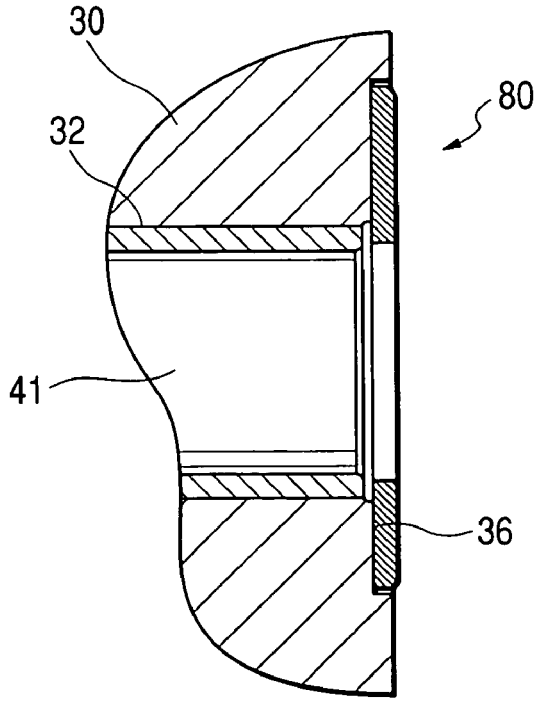

FIGS. 5(*a*) and 5(*b*) show the fourth embodiment of the invention which is different from the first embodiment only in the geometrical shape of washers 80 and washer chambers 36 formed in the cam cover 30 and the housing 10. Other arrangements are identical, and explanation thereof in detail will be omitted here.

The washer 80 has the center shifted from the center of the cam shaft 41. In other words, the washer 80 is located eccentrically to the cam shaft 41. The washer chamber 36 is, thus, formed in the cam cover 30 eccentrically to the cam shaft 41.

The eccentric installation of the washer 80 serves to avoid relative motion of the washer 80 and the cam cover 30.

Figure 6A:
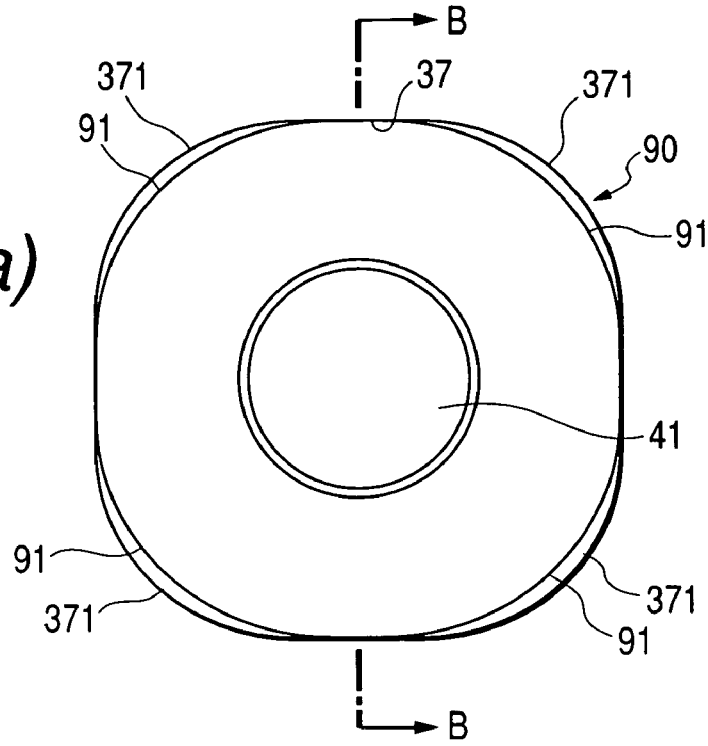
FIG. 6(*a*) is a front view which shows a washer installed between a cam and each of a cam cover and a housing according to the fifth embodiment of the invention.
Figure 6B:
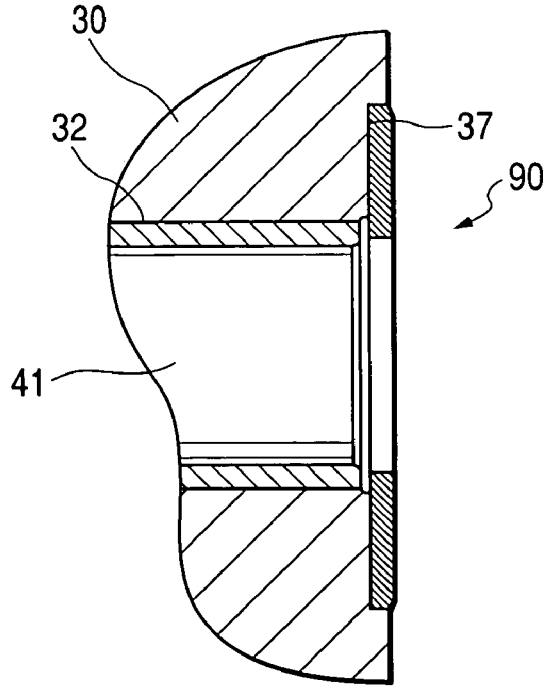

FIGS. 6(*a*) and 6(*b*) show the fifth embodiment of the invention which is different from the first embodiment in the geometrical shape of washers 90 and washer chambers 37 formed in the cam cover 30 and the housing 10. Other arrangements are identical, and explanation thereof in detail will be omitted here.

The washer 90 and the washer chamber 37 are of polygonal shape in an external form. The washer 90 has four round corners 91 which have radius of curvature smaller than that of round corners 371 of the washer chamber 37. The corners 91 of the washer 90 may alternatively be identical in radius of curvature with the corners 371 of the washer chamber 37.

The polygonal shape of the washer 90 and the washer chamber 37 serve to avoid relative motion of the washer 90 and the cam cover 30.

The corners 91 of the washers 90 and the corners 371 of the washer chambers 37 may alternatively be formed to have a sharp angle. The washers 90 and the washer chambers 37 may not always be of square shape, but may be of polygonal shape such as triangular or pentagonal shape.

Figure 7A:
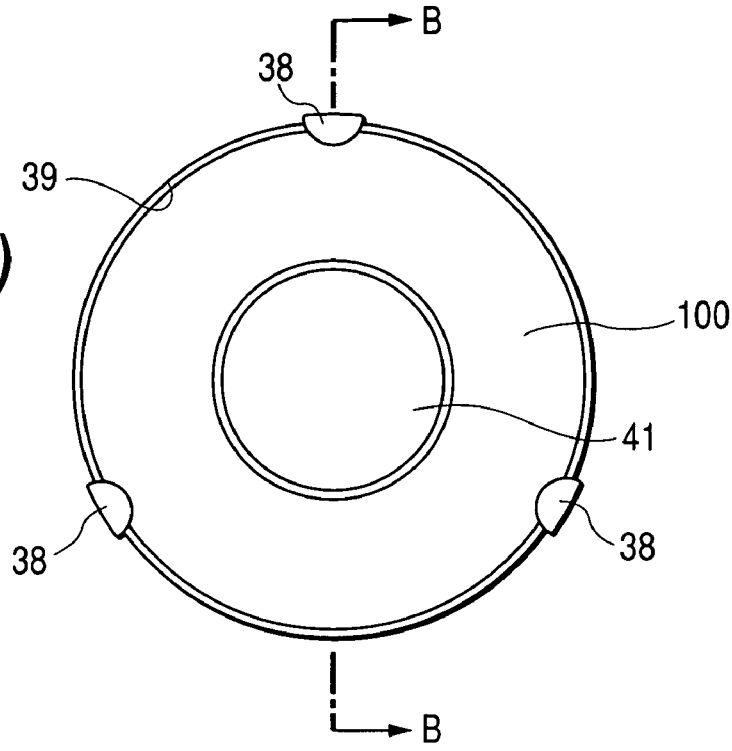
FIG. 7(*a*) is a front view which shows a washer installed between a cam and each of a cam cover and a housing according to the sixth embodiment of the invention.
Figure 7B:
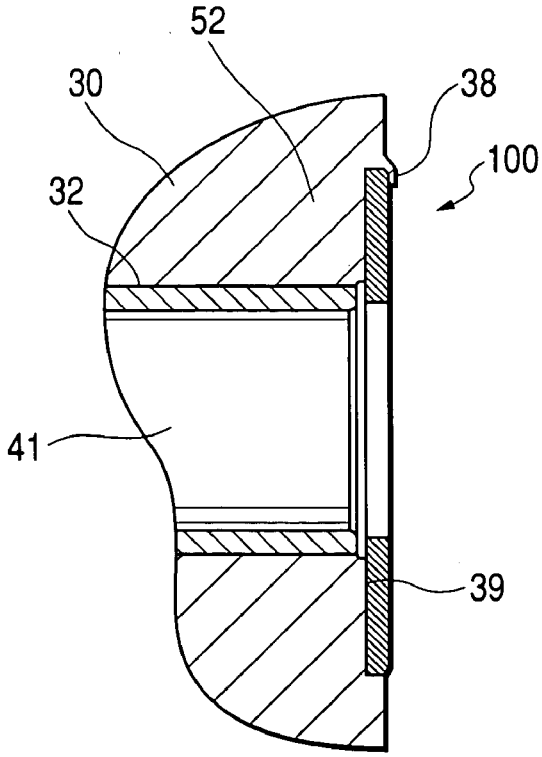

FIGS. 7(*a*) and 7(*b*) show the sixth embodiment of the invention which is different from the first embodiment in that the cam cover 30 and the housing 10 have tabs 38 for holding washers 100 in washer chambers 39 instead of the pins 52. Other arrangements are identical, and explanation thereof in detail will be omitted here.

The washer 100 is made of a disc member. The washer chamber 39 are substantially identical in external form with the washer 100. The three tabs 38 are formed on a peripheral edge of the washer chamber 39 at a regular interval of 120°. After the washer 100 is placed in the washer chamber 39, the tabs 38 are bent inward to hold the washer 100 tightly.

The washers 100 may alternatively be retained in the cam cover 30 and the housing 10 using two or more than three tabs formed in the periphery of the washer chambers 39.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims. For instance, a combination of the structures of the first to sixth embodiments may be used. The washers of any of the first to sixth embodiments may be welded directly to the cam cover 30 and the housing 10. Only one washer may be installed on the cam cover 30, thereby minimizing wear of the cam cover 30, especially due to the thrust acting on the cam shaft 41 in the direction B. The structure, as described in any of the above embodiments, is also useful for a fuel injection pump in which no thrust acts on the cam shaft 41 in minimizing wear of cam-bearing walls of a pump housing.

What is claimed is:

1. A fuel injection pump comprising:

a housing having a first and a second chamber formed therein;

a plunger disposed within the first chamber of said housing so as to reciprocate along a given path of travel;

a cam mechanism installed on a torque input shaft, said cam mechanism revolving within the second chamber following rotation of the torque input shaft to move said plunger within the first chamber for compressing fuel sucked into a fuel compression chamber;

a washer chamber formed in an inner wall of said second chamber of said housing, said washer chamber being located in an axial direction of said cam mechanism;

a washer installed fixedly within said washer chamber, said washer working as a bearing surface which is in contact with and holds said cam mechanism from moving in the axial direction thereof, wherein said washer is placed within said washer chamber with a clearance gap between an outer circumference thereof and an inner circumference of said washer chamber such that said washer is subject to movement within said washer chamber following revolution of said cam mechanism, and wherein said washer is secured within the washer chamber at at least two peripheral portions of said washer using fastening members to avoid movement of said washer following the revolution of said cam mechanism.

2. A fuel injection pump as set forth in claim 1, wherein said washer is made of an annular disc through which the torque input shaft extends.

3. A fuel injection pump as set forth in claim 1, wherein said fastening members are formed integrally with said washer.

4. A fuel injection pump as set forth in claim 1, wherein said fastening members comprised protrusions formed on a periphery said washer which engage mating parts provided on a periphery of the washer chamber.

5. A fuel injection pump as set forth in claim 1, wherein said washer and the washer chamber are so shaped geometrically as to hold relative motion thereof.

6. A fuel injection pump as set forth in claim 5, wherein said washer and the washer chamber are located eccentrically to the torque input shaft.

7. A fuel injection pump as set forth in claim 5, wherein said washer and the washer chamber are of polygonal shape.

8. A fuel injection pump as set forth in claim 1, wherein said washer is fitted within the washer chamber.

9. A fuel injection pump as set forth in claim 1, wherein said fastening members comprise holding members provided around a periphery of the washer chamber.

10. A fuel injection pump as set forth in claim 1, wherein the fastening members are located at equi-angular intervals in a circumferential direction of said washer.

11. A fuel injection pump as set forth in claim 1, wherein each of the fastening members and said washer are formed non-integrally with each other.

* * * * *